US010544551B2

(12) United States Patent
Hirman et al.

(10) Patent No.: US 10,544,551 B2
(45) Date of Patent: Jan. 28, 2020

(54) VENTILATION SYSTEM AND METHOD FOR COLD PLANER MACHINE

(71) Applicant: Caterpillar Paving Products Inc., Brooklyn Park, MN (US)

(72) Inventors: Colton J. Hirman, Rosemount, MN (US); Jason R. Bjorge, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 558 days.

(21) Appl. No.: 15/170,597

(22) Filed: Jun. 1, 2016

(65) Prior Publication Data

US 2017/0350080 A1 Dec. 7, 2017

(51) Int. Cl.

| | |
|---|---|
| ***E01C 23/088*** | (2006.01) |
| ***B08B 9/032*** | (2006.01) |
| ***B08B 9/08*** | (2006.01) |
| ***E01C 23/12*** | (2006.01) |

(52) U.S. Cl.

CPC ..... *E01C 23/088* (2013.01); *B08B 9/0321* (2013.01); *B08B 9/0813* (2013.01); *B08B 9/0861* (2013.01); *E01C 23/127* (2013.01); *E01C 2301/00* (2013.01)

(58) Field of Classification Search

CPC ... B08B 9/0321; B08B 9/0813; B08B 9/0861; B08B 15/04; E01C 2301/00; E01C 23/088; E01C 23/127

See application file for complete search history.

(56) References Cited

U.S. PATENT DOCUMENTS

| | | | | |
|---|---|---|---|---|
| 4,531,784 | A * | 7/1985 | Karlovsky | E21C 35/223 299/12 |
| 4,561,145 | A * | 12/1985 | Latham | E01C 23/08 15/340.3 |
| 7,175,364 | B2 | 2/2007 | Gaertner et al. | |
| 8,985,701 | B2 | 3/2015 | Denson et al. | |
| 2004/0036346 | A1* | 2/2004 | Johannes Klaasse | E01C 23/088 299/39.2 |
| 2004/0148823 | A1* | 8/2004 | Schenk | E01C 21/00 37/466 |

(Continued)

FOREIGN PATENT DOCUMENTS

| | | |
|---|---|---|
| DE | 10 2005 035 480 A1 | 2/2007 |
| KR | 10-0910647 | 8/2009 |

*Primary Examiner* — Douglas Lee
(74) *Attorney, Agent, or Firm* — Oblon, McClelland, Maier & Neustadt

(57) ABSTRACT

A ventilation system and method for a cold planer are provided. The ventilation system includes a settling box inside a water tank. The settling box includes a body. The body includes at least one sidewall defining an air inlet having a first cross-section to accept dust and fumes generated by a milling drum operation of the cold planer but to reject particles from the milling drum operation at or above a predetermined size. The settling box further includes an air outlet having a second cross-section less than the first cross-section of the air inlet. The ventilation system further includes an outlet pipe connected to the air outlet, a fan and a cleaning system. The fan is configured to pull air from below the air inlet into the settling box, through the air outlet and to the outlet pipe.

14 Claims, 8 Drawing Sheets

(56) References Cited

U.S. PATENT DOCUMENTS

2011/0278907 A1* 11/2011 Moller ..... E01C 23/088
299/18
2014/0015303 A1* 1/2014 Denson ..... E01C 23/088
299/39.2

* cited by examiner

VENTILATION SYSTEM AND METHOD FOR COLD PLANER MACHINE

TECHNICAL FIELD

The present disclosure generally relates to cold planer machines, and more particularly relates to a ventilation system and a method for ventilating a cold planer machine.

BACKGROUND

A machine, such as a cold planer, is typically employed to break up or remove a surface from a paved area. The cold planer, also referred to as a road mill, typically includes a milling system. The milling system includes a milling drum having a plurality of teeth. The milling system draws power from an engine through a suitable interface to rotate the milling drum to perform milling operations on the surface of the paved area. The surface of the paved area breaks due to rotation of the milling drum against the surface. The rotation of the milling drum can also deposit material from the broken up surface to a primary conveyor. The primary conveyor transfers the material to a secondary conveyor, which in-turn can transport the material to a nearby haul vehicle. During such breaking up of the surface, dust and particles of material smaller than the deposited material may also be produced. A ventilation system can be employed to remove the dust and smaller particles from the vicinity of the milling drum, the primary conveyor, and operator area. The ventilation system draws and transports the dust and smaller particles of material from the vicinity of the milling drum and the primary conveyor to a distant discharge location, for example, the secondary conveyor.

U.S. Pat. No. 8,985,701, hereinafter the '701 patent, describes a cold planer having a multi-inlet exhaust system that may have (i) an inlet manifold located downstream of a milling drum and above a material conveyor, where the inlet manifold may be configured to receive dust and fumes generated by the milling drum, (ii) at least one inlet passage located at a side of the material conveyor and gravitationally lower than the inlet manifold, where the at least one inlet passage may be configured to receive dust and fumes generated by the milling drum, and (iii) a ventilator in fluid communication with the inlet manifold and the at least one inlet passage, where the ventilator may be configured to draw the dust and fumes from the inlet manifold and the at least one inlet passage. According to the '701 patent, the inlet manifold and inlet extensions may be placed downstream of the milling drum at about 300-800 mm downstream of the milling drum so as to avoid drawing in larger fragments of milled material thrown into the air by cutting tools of the cold planer.

SUMMARY OF THE DISCLOSURE

In an aspect of the present disclosure, a ventilation system for a cold planer is provided. The ventilation system includes a vertically oriented settling box inside a water tank of the cold planer. The settling box includes a body with a height greater than a width separating an inner volume of the settling box from the water tank. The body includes at least one vertically extending sidewall defining a down-facing air inlet having a first cross-section sized to accept dust and fumes generated by a milling drum operation of the cold planer but to reject particles from the milling drum operation with a diameter 1 mm or greater. The settling box further includes an air outlet provided on the at least one vertically extending sidewall at a height above the down-facing air inlet. The air outlet includes a second cross-section less than the first cross-section of the down-facing air inlet and faces away from an operator area of the cold planer. The ventilation system further includes an outlet pipe, a fan, and a cleaning system. The outlet pipe is connected to the air outlet of the settling box and extends from the air outlet of the settling box such that at least a first portion of the outlet pipe is inclined upward and at least a second portion of the outlet pipe is inside the water tank. The fan is adapted to pull air from below the down-facing air inlet into the settling box, through the air outlet and to the outlet pipe. The cleaning system is configured to clean the vertically oriented settling box and the outlet pipe. The cleaning system includes one or more spray nozzles to spray cleaning fluid into the outlet pipe. The outlet pipe is configured to allow the cleaning fluid to gravitationally flow to the air outlet and inner volume of the settling box.

In another aspect of the present disclosure, an air ventilation system for a cold planer is provided. The air ventilation system includes at least one vertically oriented pickup box inside a water tank of the cold planer. Each of the at least one first pickup box includes a body and an air outlet. The body separates an inner volume of the pickup box from the water tank and includes at least one vertically extending sidewall defining a down-facing air inlet having a first cross-section. The air outlet is provided on the at least one vertically extending sidewall at a height above the down-facing air inlet. Further, the air outlet includes a second cross-section less than the first cross-section of the down-facing air inlet and faces away from an operator area of the cold planer. The air ventilation system further includes at least one air outlet pipe connected to the air outlet of the at least one pickup box and extending from the air outlet of the pickup box such that at least a first portion of the outlet pipe is inside the water tank. The vertical orientation of the pickup box, a height of the body of the at least one pickup box, the inner volume of the at least one pickup box, and the first cross-section of the down-facing air inlet are configured to allow passage into the air ventilation system of fumes and particles no larger than a first size and disallow passage of particles larger than the first size from reaching a predetermined point of the air ventilation system downstream of the down-facing air inlet.

In yet another aspect of the present disclosure, a method of providing for ventilation of a cold planer is provided. The method includes providing a settling box inside a water tank of a cold planer. The settling box includes a body and an air outlet. The body separates an inner volume of the settling box from the water tank. The body includes at least one vertically extending sidewall defining a down-facing air inlet having a first cross-section. The air outlet is provided on the at least one vertically extending sidewall at a height above the down-facing air inlet. The air outlet includes a second cross-section less than the first cross-section of the down-facing air inlet and faces away from an operator area of the cold planer. The method further includes providing at least one air outlet pipe connected to the air outlet of the settling box and extending from the air outlet of the settling box such that at least a first portion of the outlet pipe runs through the water tank, away from the operator area of the cold planer. The first cross-section of the down-facing air inlet is configured to allow fumes and particles no larger than a first size to pass into the settling box and disallow passage of particles larger than the first size from reaching a predetermined point downstream of the down-facing air inlet.

Other features and aspects of this disclosure will be apparent from the following description and the accompanying drawings.

DETAILED DESCRIPTION

Figure 1:
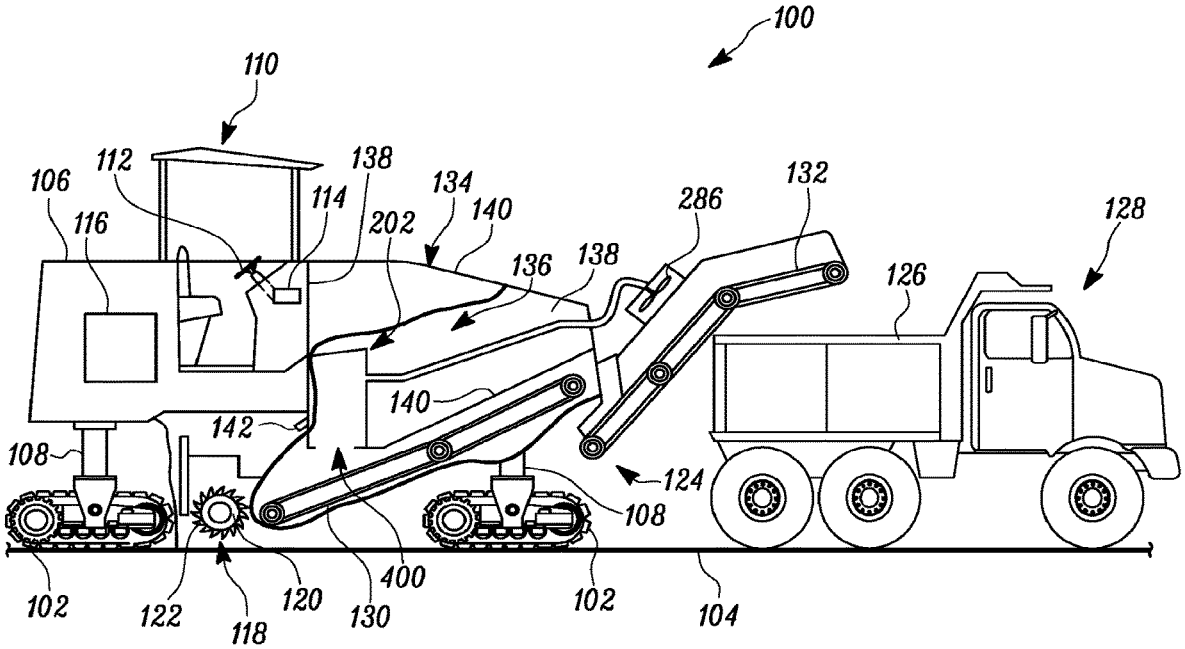
FIG. 1 is a cross-sectional side view of a cold planer, according to one or more embodiments of the present disclosure.
Figure 2:
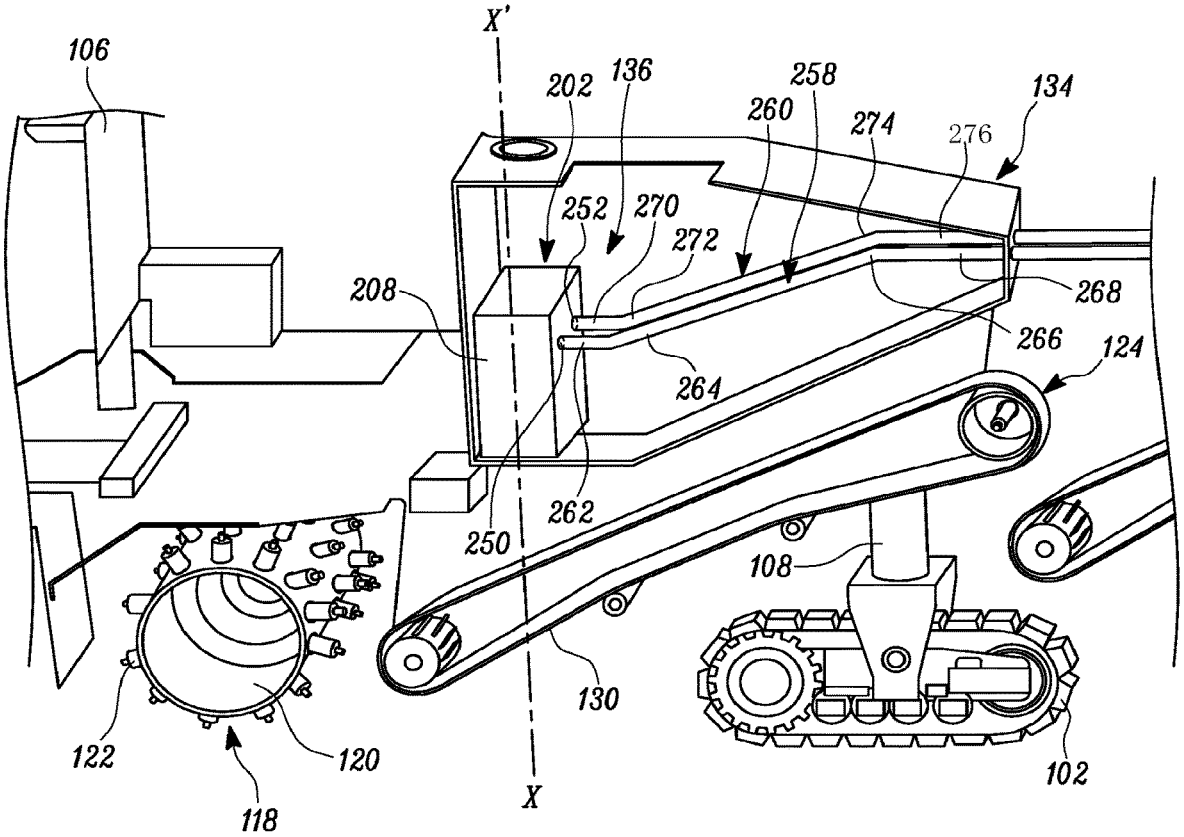
FIG. 2 is a partial cross-sectional view of a portion of the cold planer of FIG. 1, according to one or more embodiments of the present disclosure.
Figure 3:
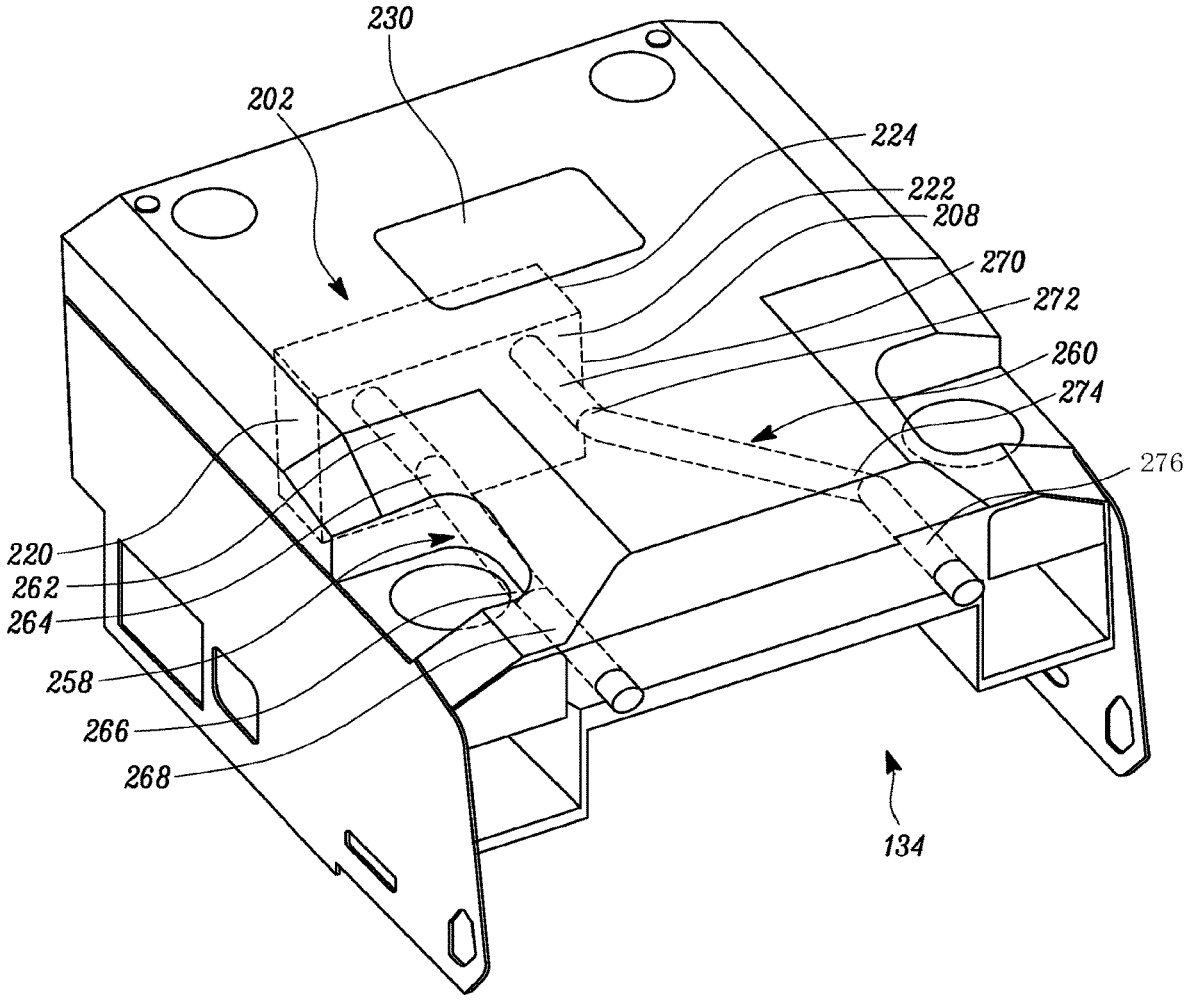
FIG. 3 is a top perspective view of a portion of the cold planer of FIG. 2 showing a settling or pickup box of a ventilation system of the cold planer, according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular is also to be construed to relate to the plural and vice-versa without limiting the scope of the disclosure to the exact number or type of such elements unless set forth explicitly in the appended claims.

As noted above, embodiments of the disclosed subject matter are directed to and involve systems and methods for ventilating a cold planer machine. More particularly, embodiments of the disclosed subject matter can allow dust and particles from a milling operation to be received by and output from a ventilation system of the cold planer, but disallow particles greater than a predetermined size to either enter the ventilation system or travel past a predetermined point of the ventilation system, by providing a specific ventilation system configuration that creates a maximum airflow with a minimum surface velocity at an air inlet (or inlets) of the ventilation system. For example, at least one hollow settling or pickup member is provided that, based on the relatively large size of its air inlet opening(s) and orientation to primarily cause vertical airflow, can create maximum airflow with minimum surface or face velocity at the opening to prevent or discourage particles greater than a predetermined size to either enter the ventilation system or travel past a predetermined point of the ventilation system.

FIG. 1 illustrates a partial cross-sectional side view of an exemplary cold planer 100, according to one or more embodiments of the present disclosure. The "cold planer" may be defined as any machine used to break and remove layers of hardened material from an existing road surface. The cold planer 100, also interchangeably referred to as "the cold planer machine 100," or "the machine 100," can include a plurality of ground engaging units 102 for propelling the machine 100 along a road surface 104. The ground engaging units 102 of the machine 100 are connected to a frame 106 of the machine 100 by hydraulic legs 108. Although the ground engaging units 102 of the machine 100 are shown to include tracks, the ground engaging units 102 may alternatively include a set of wheels.

The frame 106 supports an operator area 110 having a steering command element 112 and a controller 114. Although, the steering command element 112 is shown to include a steering wheel in FIG. 1, other steering devices such as a joystick, buttons or levers may be implemented. The steering command element 112 may be in wireless or wired communication with the controller 114 to receive commands. The controller 114 may send control signals based on the commands, to one or more actuators (not shown) of one or more of the ground engaging units 102, and the hydraulic legs 108. In the case of electrically activated actuators, the control signals may act directly on the respective actuators. In the case of hydraulically activated actuators, the control signals may act on valves, which in turn control flow of pressurized fluid to the actuators. The controller 114 may be a separate control unit or may be part of a central control unit operable to control additional functions of the machine 100.

The frame 106 may also support a power source, such as an engine 116. The engine 116 may supply power to the ground engaging units 102 to propel the machine 100 on the road surface 104. In one embodiment, this is accomplished by driving a hydraulic pump (not illustrated) with an output of the engine 116, which in turn supplies high-pressure hydraulic fluid to individual motors (not illustrated) associated with the ground engaging units 102.

The machine 100 also includes a milling system 118, supported on the frame 106. The milling system 118 may also receive power from the engine 116. The milling system 118 facilitates milling of the road surface 104. The milling system 118 includes a milling drum 120, and a plurality of cutting tools 122 disposed circumferentially around the milling drum 120. A cutting plane of the machine 100 is tangential to the bottom of the milling system 118 and parallel to the direction of travel of the machine 100. The milling drum 120 of the milling system 118 rotates, upon receiving power from the power source, such as the engine 116, and accordingly the plurality of cutting tools 122 can be caused to come in repeated contact with the road surface 104 to break up a layer of material from the road surface 104. The hydraulic legs 108 can act as elongated telescopic actuators configured to raise and lower the milling system 118 relative to the ground engaging units 102 so as to control a depth of cut by the milling system 118.

A conveyor system 124 is provided on the machine 10 to collect material, such as excavated asphalt produced during breaking up of the road surface 104, by the milling system 118. The conveyor system 124 also transports the collected material to a discharge location, such as a bed 126 of a transport vehicle 128, which may be, for instance, an on-highway haul truck, an off-highway articulated or non-articulated truck, or any other type of transport vehicle known in the art. Specifically, the conveyor system 124 can include a lower conveyor belt 130 and an upper conveyor belt 132 positioned adjacent to the lower conveyor belt 130. The lower conveyor belt 130 can collect the material and transport the material to the upper conveyor belt 132, while the upper conveyor belt 132 transports the material to the discharge location. In various embodiments, the upper conveyor belt 132 may be movable relative to the lower conveyor belt 130 in a vertical direction and/or a horizontal direction so as to adjust the conveyor system 132 with respect to the discharge location.

The machine 100 further includes a water tank 134 and a ventilation system 136, supported on the frame 106 of the machine 100. The water tank 134 is positioned under a hood of the machine 100, proximate to the milling system 118 and the conveyor system 124. The water tank 134 can have box structure with a predefined inner volume defined by a plurality of connected sidewalls 138 connected to bottom and top panels 140. The water tank 134 is adapted to hold a predetermined quality of water. The water tank 134 includes at least one water nozzle 142 to selectively dispense the water stored in the water tank 134 toward the milling drum 120 and the plurality of cutting tools 122 of the milling system 118. The ventilation system 136, also referred to as "air ventilation system," may be integrated with the water tank 134, to provide ventilation for byproducts of the milling operation, such as dust and fumes.

Figure 5:
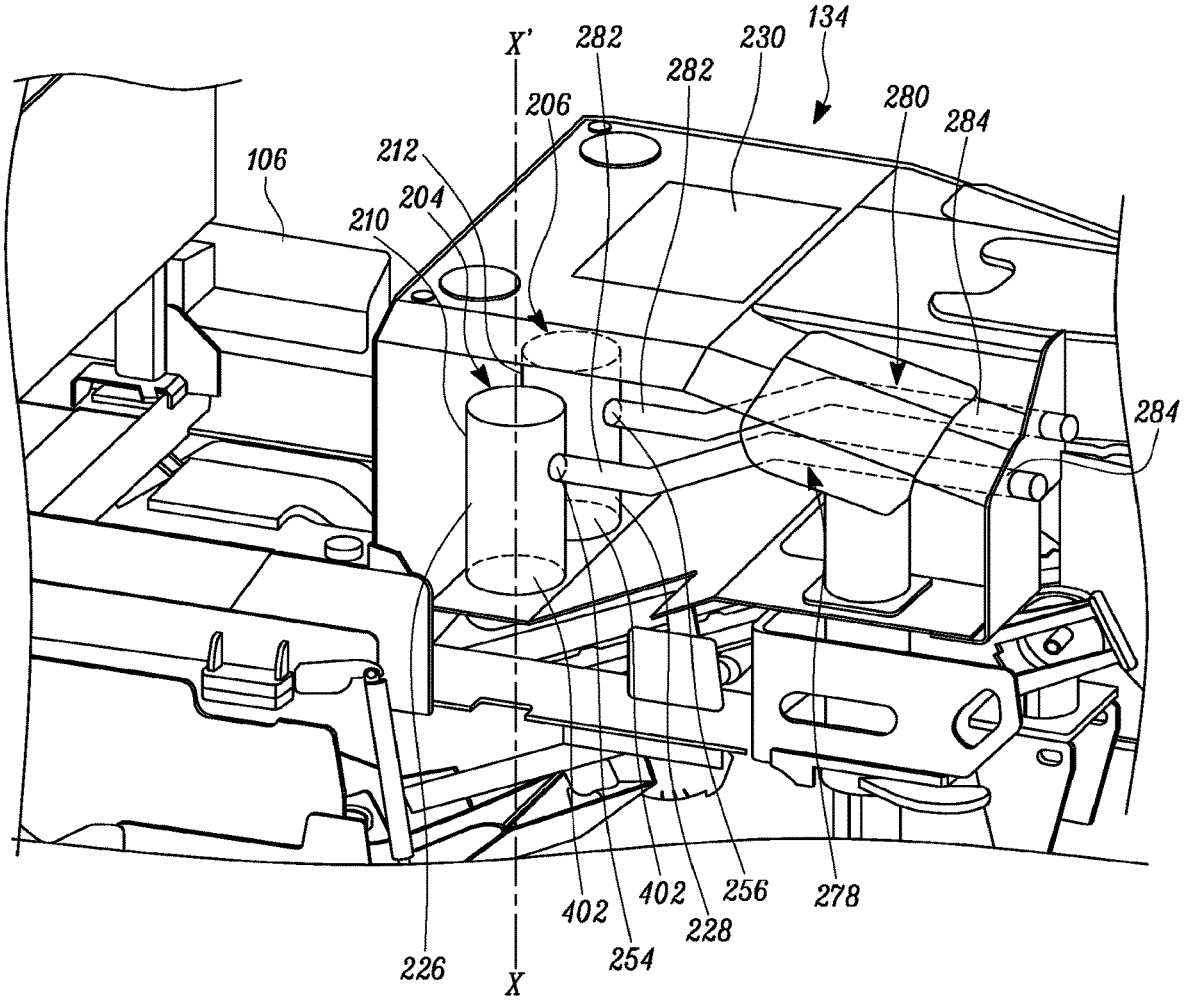
FIG. 5 is a partial cross-sectional view of a portion of the cold planer showing a plurality of settling or pickup members of a ventilation system of the cold planer, according to one or more embodiments of the present disclosure.
Figure 6:
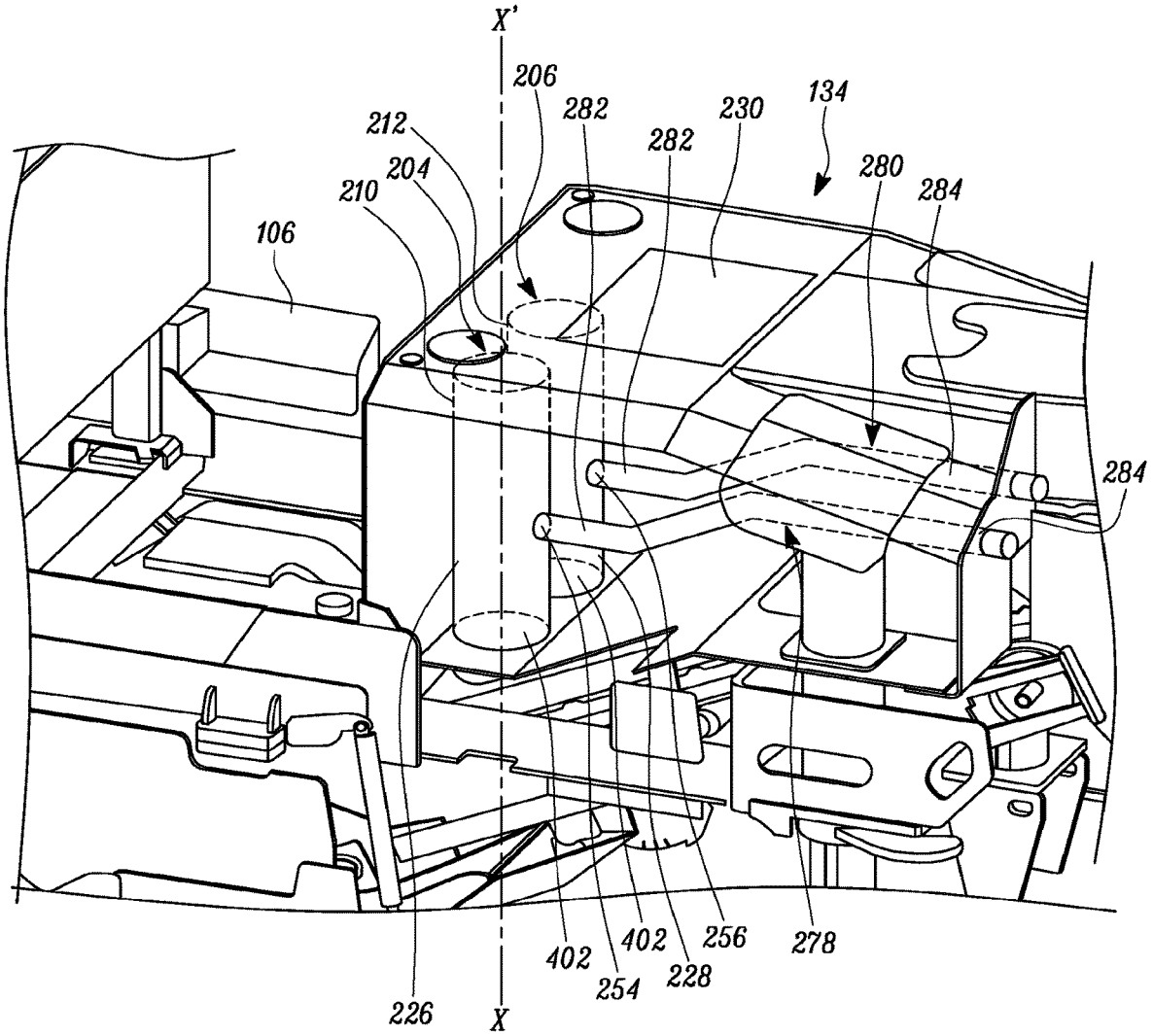
FIG. 6 is a partial cross-sectional illustration of a portion of the cold planer showing a plurality of settling or pickup members of a ventilation system of the cold planer, according to one or more embodiments of the present disclosure.
Figure 7:
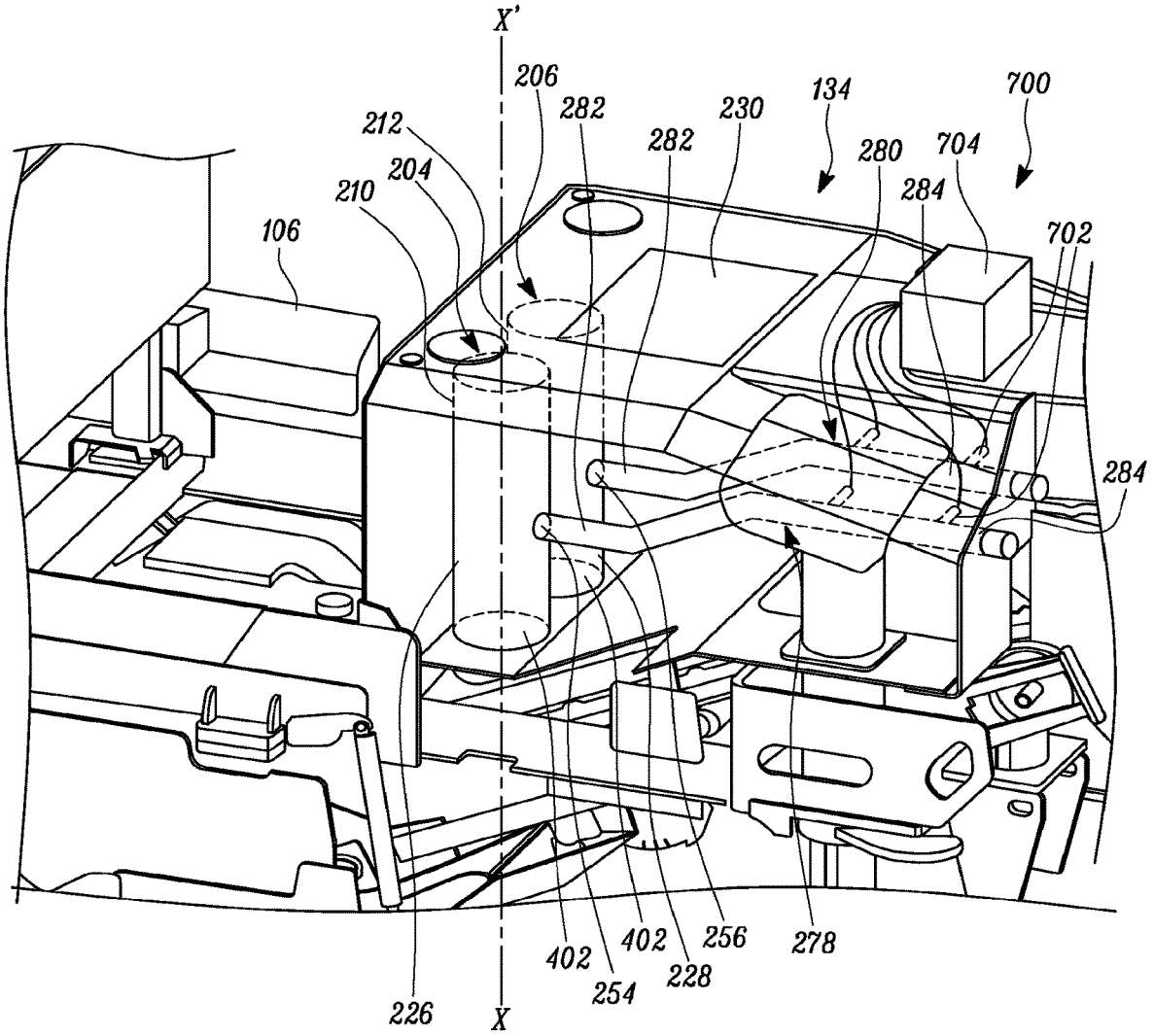
FIG. 7 is a partial cross-sectional illustration of a portion of the cold planer having a high-pressure water system, according to one or more embodiments of the present disclosure.

As illustrated in FIGS. 1, 2, 3 and 4, the ventilation system 136 includes at least one settling box, such as a settling box 202, positioned inside the water tank 134. The settling box 202, also interchangeably referred to as "a pickup box" or "pickup member," is vertically oriented within the water tank 134, for instance, along an axis X-X.' In alternative embodiments of the present disclosure, the ventilation system 136 includes two settling boxes, such as a settling box 204, and a settling box 206, as shown in FIGS. 5, 6 and 7. In other embodiments of the present disclosure, the ventilation system 136 may include more than two settling boxes, each positioned inside the water tank 134.

Each settling box includes a body. For instance, the settling box 202 includes a body 208. Likewise, the settling boxes 204 and 206 include a body 210 and a body 212, respectively. The body 208 of the settling box 202 has a predetermined geometric shape with a predetermined height and a predetermined width, defining an inner volume. The height of the body 208 may be measured along the axis X-X.' Likewise, the bodies 210 and 212 also have a predetermined geometric shape having a predetermined height and a predetermined cross-section (e.g., diameter), each defining an inner volume, and the height of bodies 210 and 212 may be measured along the axis X-X.' The body 208 of the settling box 202 may have a rectangular configuration, as shown in FIGS. 1, 2, 3 and 4, whereas the bodies 210 and 212 may have a cylindrical configuration with a circular cross-section, as shown in FIGS. 5, 6 and 7.

The body 210 of the settling box 204 and the body 212 of the settling box 206 may be identical in shape, and define inner cylindrical volumes. Alternatively, shape of the body 210 of the settling box 204 may be different from the shape of the body 212 of the settling box 206. In other embodiments of the present disclosure, the body 208, the body 210 or the body 212, may have another configuration, such as, but not limited to, a conical configuration, a frustoconical configuration, a cuboidal configuration, and a spherical configuration. Other geometric shapes may also be provided, such as parallelepiped.

Further, as illustrated, the height of the body 208 can be greater that the width of the body 208. The height of the body 210 of the settling box 204 may be equal to the height of the body 212 of the settling box 206. Alternatively, the height of the body 210 of the settling box 204 may be different from the height of the body 212 of the settling box 206. However, the height of body 210 of the settling box 204 can be greater that the width (diameter) of the body 210, and the height of the body 212 of the settling box 206 can be greater that the width (diameter) of the body 212.

The body of each of the settling boxes can have at least one vertically extending sidewall. In an embodiment, the at least one vertically extending sidewall includes three or four vertically extending sidewalls. For example, the body 208 of the settling box 202 has a first vertically extending sidewall 220, a second vertically extending sidewall 222, a third vertically extending sidewall 224 and a fourth vertically extending sidewall (not illustrated). The body 210 of the settling box 204 has a vertically extending sidewall 226, and the body 212 of the settling box 206 has a vertically extending sidewall 228. Of course, "vertically extending" may be defined as extending only in the vertical direction or extending vertically and to some degree horizontally, for instance, five degrees or less or ten degrees or less from vertical. Additionally, a combination of the foregoing may be implemented in one or more embodiments of the disclosed subject matter.

Each sidewall has a predefined length extending along the X-X' axis between a top portion and a bottom portion. For example, the first vertically extending sidewall 220 is connected to the second vertically extending sidewall 222, and the third vertically extending sidewall 224 is connected to the second vertically extending sidewall 222. In one embodiment, the first vertically extending sidewall 220 and the third vertically extending sidewall 224 are connected to an inner side of a sidewall of the plurality of connected sidewalls 138 of the water tank 134, to define an inner volume of a rectangular shape or a cuboidal shape.

The body 208 can separate the inner volume of the settling box 202 from the water tank 134. Access to the inner volume of the settling box 202 can be provided by removing a top cover 230 of the water tank 134. The height of the body 208 of the settling box 202 may extend to the top cover 230 of the water tank 134. In an alternative embodiment, the height of the body 208 of the settling box 202 does not extend to the top cover 23 of the water tank 134.

As shown in FIG. 5, the height of the body 210 and the body 212 of the settling box 204 and the settling box 206 may be half or less than half of a height of the water tank 134. In the embodiments shown in FIGS. 6 and 7, the heights of the body 210 and the body 212 of the settling box 204 and the settling box 206, respectively, can be equal to or at the height of the water tank 134. Thus, the top cover 230 of the water tank defines a top cover of up-facing openings defined by the least one vertically extending sidewall, such as the vertically extending sidewall 226 and the vertically extending sidewall 228. Alternatively, each of the up-facing openings may have their own top covers to allow access thereto.

Figure 4:
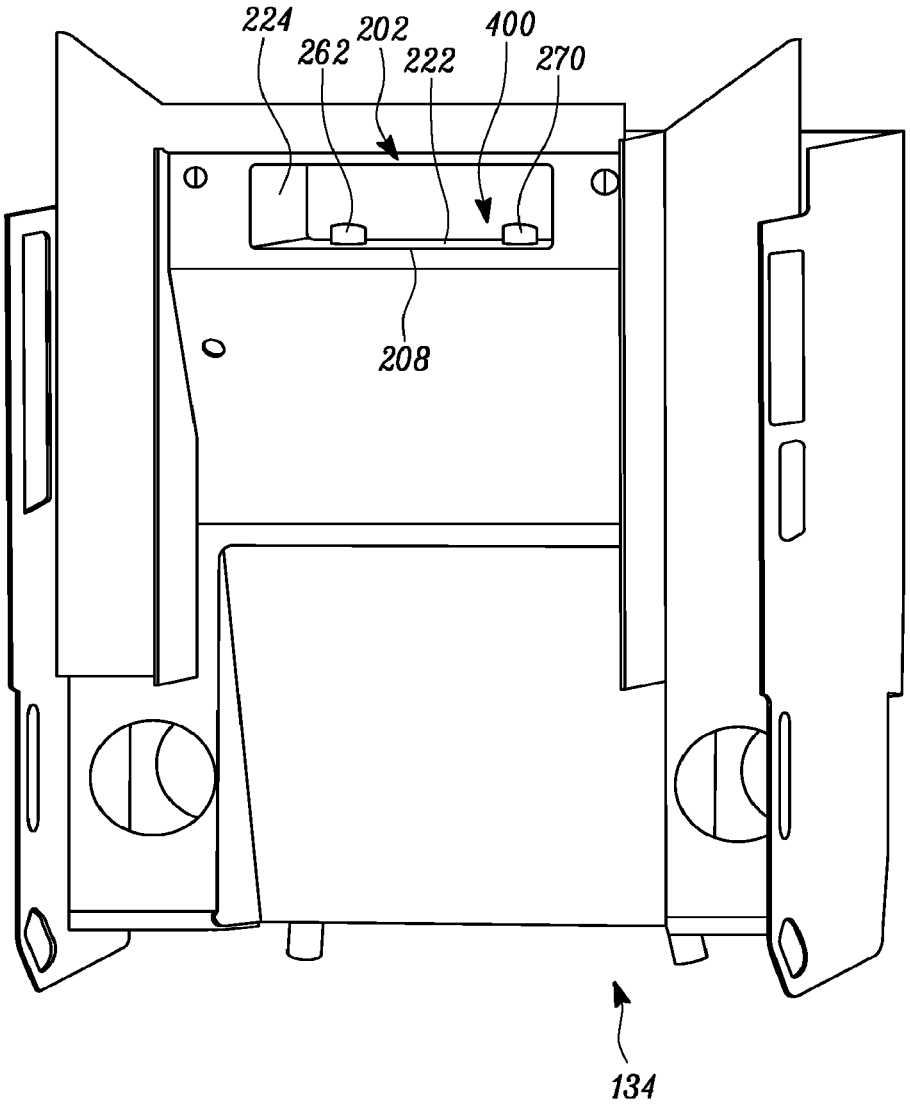
FIG. 4 is a bottom perspective view of a portion of the cold planer of FIG. 2 showing the settling or pickup box of FIG. 3.

The first vertically extending sidewall 220, the second vertically extending sidewall 222, the third vertically extending sidewall 224, and the fourth vertically extending sidewall (not illustrated) can define a down-facing air inlet 400 (shown in FIG. 4). Specifically, as shown in FIG. 4, the bottom portion of the first vertically extending sidewall 220, the second vertically extending sidewall 222, the third vertically extending sidewall 224, and the fourth vertically extending sidewall can define the down-facing air inlet 400.

Likewise, each of the vertically extending sidewall 226 of the body 210 and the vertically extending sidewall 228 of the body 212 can define the down-facing air inlet 402. The down-facing air inlet 400 has a first cross-sectional area. In one embodiment, the cross-sectional area of the down-facing air inlet 400 may be equal to a cross-sectional area of the body 208. In alternative embodiments, the cross-sectional area of the down-facing air inlet 400 may be greater than the cross-sectional area of the body 208. For example, the body 208 may taper inward in an upward direction from the down-facing air inlet 400.

The cross-sectional area of the down-facing air inlet 400 and 402, i.e., the first cross-sectional area (or first cross-sectional areas), can be positioned downward, directly downward, for instance, generally toward the milling system 118 and the conveyor system 124. The first cross-sectional area is sized to create a maximum airflow with a minimum surface velocity at the down-facing air inlets 400 and 402 so as to accept only dust and fumes generated by operation of the milling drum 120 of the machine 100. Further, the first cross-sectional area can be sized to reject particles which are of a size (e.g., diameter or cross-section) greater than a predetermined size (also referred to as "a first size") generated by the milling drum 120 of the machine 100. In one embodiment, the first cross-section 400 and 402 may be sized to reject particles from the milling drum operation with a diameter 1 millimeter (mm) or greater than 1 mm.

The bodies of the settling boxes, which may be made from a durable rigid material, such as but not limited to metal, metallic alloy, and plastic, can act as a guiding channel to allow passage of dust, fumes and particles of size less that the predetermined size through the guiding channel, i.e., from the bottom portion towards the top portion. Specifically, the body 202, the body 210 and the body 212 act as guiding channels to allow passage of dust, fumes and particles of size less that the predetermined size through the guiding channels, i.e., from the bottom portion towards the top portion. Alternatively, the settling boxes can stop passage of particles of the predetermined size or greater from reaching a predetermined part of the ventilation system 136, such as air outlets 250, 252, 254, 256. The guiding channel can be substantially perpendicular to the road surface 104.

To release the dust, fumes and other particles, the settling boxes are provided with at least one air outlet. For example, the settling box 202 includes an air outlet 250 and a second air outlet 252. One or more of the air outlet 250 and the second air outlet 252 may be provided on one or more of the first vertically extending sidewall 220, the second vertically extending sidewall 222 and the third vertically extending sidewall 224. In an embodiment, the air outlet 250 and the air second outlet 252 are provided on the second vertically extending sidewall 222. The settling box 204 includes an air outlet 254 on the vertically extending sidewall 226, and the settling box 206 includes an air outlet 256 on the vertically extending sidewall 228.

The air outlets 250, 252, 254, and 256 may be in a form of a circular opening, and may be provided at a predetermined height on the respective sidewalls from the bottom portion thereof (i.e., from the down-facing opening 400 or openings 402). In an embodiment, the air outlet 250 and the air outlet 252 are provided at a height above the down-facing air inlet 400. Further, the air outlet 254 and the air outlet 256 are provided at a height above the down-facing air inlet 402. Each of the air outlet 250, the air outlet 252, the air outlet 254, and the air outlet 256 has a cross-section, referred to herein as a second cross-section. In an embodiment, the second cross-section is less than the first cross-section of the down-facing air inlet 400 or down-facing air inlets 402. As illustrated, the air outlets 250, 252, 254, and 256 can face away from the operator area 110 of the machine 100.

At least one outlet pipe is connected to the at least one air outlet. In an embodiment, an outlet pipe 258 is connected to the air outlet 250 of the settling box 202 and can extend outward. Likewise, a second outlet pipe 260 is connected to the second air outlet 250 of the setting box 202 and can extend outward. As illustrated, the outlet pipe 258 may optionally protrude into the inner volume of the settling box 202 through the air outlet 250, and the second outlet pipe 260 may protrude into the inner volume of the setting box 202 through the second air outlet 250.

The outlet pipe 258 can include a first end portion 262, a first portion 264, a second portion 266, and a second end portion 268. The first portion 264 and the second portion 266 connect the first end portion 262 with the second end portion 268 to define a length of the outlet pipe 258. The first end portion 262 of the outlet pipe 258 is connected to the air outlet 250. The first end portion 262 of the outlet pipe 258 may have a tubular configuration having a diameter corresponding to diameter of the air outlet 250. The first portion 264 of the outlet pipe 258 may be inclined in an upward direction. Likewise, the second portion 266 of the outlet pipe 258 may be inclined in the upward direction. The second portion 266 of the outlet pipe 258 can be positioned inside the water tank 134.

The second outlet pipe 268 can include a first end portion 270, a first portion 272, a second portion 274, and a second end portion 276. The first portion 270 and the second portion 274 connect the first end portion 274 with the second end portion 276 to define a length of the second outlet pipe 260. The first end portion 268 of the second outlet pipe 268 is connected to the second air outlet 252. The first end portion 268 of the second outlet pipe 260 may have a tubular configuration having a diameter corresponding to diameter of the second air outlet 252. The first portion 272 of the second outlet pipe 260 may be inclined in the upward direction. Likewise, the second portion 274 of the second outlet pipe 260 may be positioned inside the water tank 134. In an embodiment, the outlet pipe 258 and the second outlet pipe 260 may be straight to facilitate cleaning with a cleaning rod.

As shown in FIGS. 5, 6 and 7, the air outlet 254 on the vertically extending sidewall 226 is connected to an outlet pipe 278, and the air outlet 256 on the vertically extending sidewall 228 is connected to an outlet pipe 280. Similar to the outlet pipe 258, the outlet pipe 278 and the outlet pipe 280 can include respective first portions 282 inclined in the upward direction, and second portions 284 positioned inside the water tank 134. Therefore, the outlet pipe 258, the outlet pipe 278, and the outlet pipe 280 are routed through the water tank 134.

The ventilation system 136 further includes a fan 286 (shown in FIG. 1), configured to interact with the outlet pipes such as the outlet pipe 278. Specifically, the fan 286 can be connected to an end of the outlet pipe 278. In an alternative embodiment, the fan 286 can be connected to an end of the outlet pipe 278 through a flexible hose. The fan 286 is adapted to create a pressure difference at the outlet pipe 278 by pulling air adjacent the down-facing air inlet 400 into the inner volume of the settling box 206. As a result, the fan 286 is adapted to pull air from below the down-facing air inlet 400 into the settling box 206, through the air outlet and to the outlet pipe 280 by creating airflow through the inner volume of a predetermined rate. Thus, in conjunction with the down-facing air inlet 400, maximum airflow can be created with a minimum surface velocity at the down-facing air inlet 400. Similar or same minimum surface velocity can occur at down-facing air inlets 402, in conjunction with airflow at or above a predetermined rate.

Optionally, the ventilation system 136 of the machine 100 further includes a cleaning system 700 (shown in FIG. 7). The cleaning system 700 is configured to clean the vertically oriented settling box 202 and the outlet pipe such as the outlet pipe 258 and the outlet pipe 260. The cleaning system 700, also interchangeably referred to as "high pressure water system," is associated with the settling box 202 and the outlet pipe, such as the outlet pipe 258 and the second outlet pipe 260. In alternative embodiments, the cleaning system 700 is associated with the settling boxes 204 and 206 and the outlet pipes 278 and 280. The cleaning system 700 is configured to clean the settling boxes 204 and 206, and the outlet pipes 278 and 280.

The cleaning system 700 includes one or more nozzles 702 provided on the outlet pipes, such as the outlet pipe 278 and the outlet pipe 280. The one or more nozzles 702 are in fluid communication with a high pressure supply 704. The one or more nozzles 702 are configured to spray cleaning fluid into each of the outlet pipes 278 and 290, where the fluid can gravitationally flow to the settling boxes 204 and 206. Similarly, the one or more nozzles 702, in such a configuration, are configured to spray cleaning fluid, such as water, inside the outlet pipe 278 and the outlet pipe 280. The outlet pipe 278 and the outlet pipe 280 are configured to allow the cleaning fluid, received through the one or more nozzles 702, to gravitationally flow to the air outlet and the inner volume of the settling box 204, and the settling box 206 (and out of the ventilation system 136 through the down-facing air inlets 402).

INDUSTRIAL APPLICABILITY

The disclosed ventilation systems and methods may be used with any road material or asphalt removal system where control of milling-generated dust and fumes is desired. The disclosed ventilation system may route the dust and fumes away from the operator area (and thus the operator) by directing the milling-generated fumes and dust particles (i.e., particles less than a predetermined size) away from the operator area, while at the same time preventing or discouraging undesired entry of relatively large particles from the milling operation into the ventilation system. Additionally, embodiments of the disclosed subject matter can provide an automatic cleaning system that introduces liquid cleaning product to select portions of the ventilation system to clean out the select portions and other portions that receive the introduced liquid cleaning product.

Figure 8:
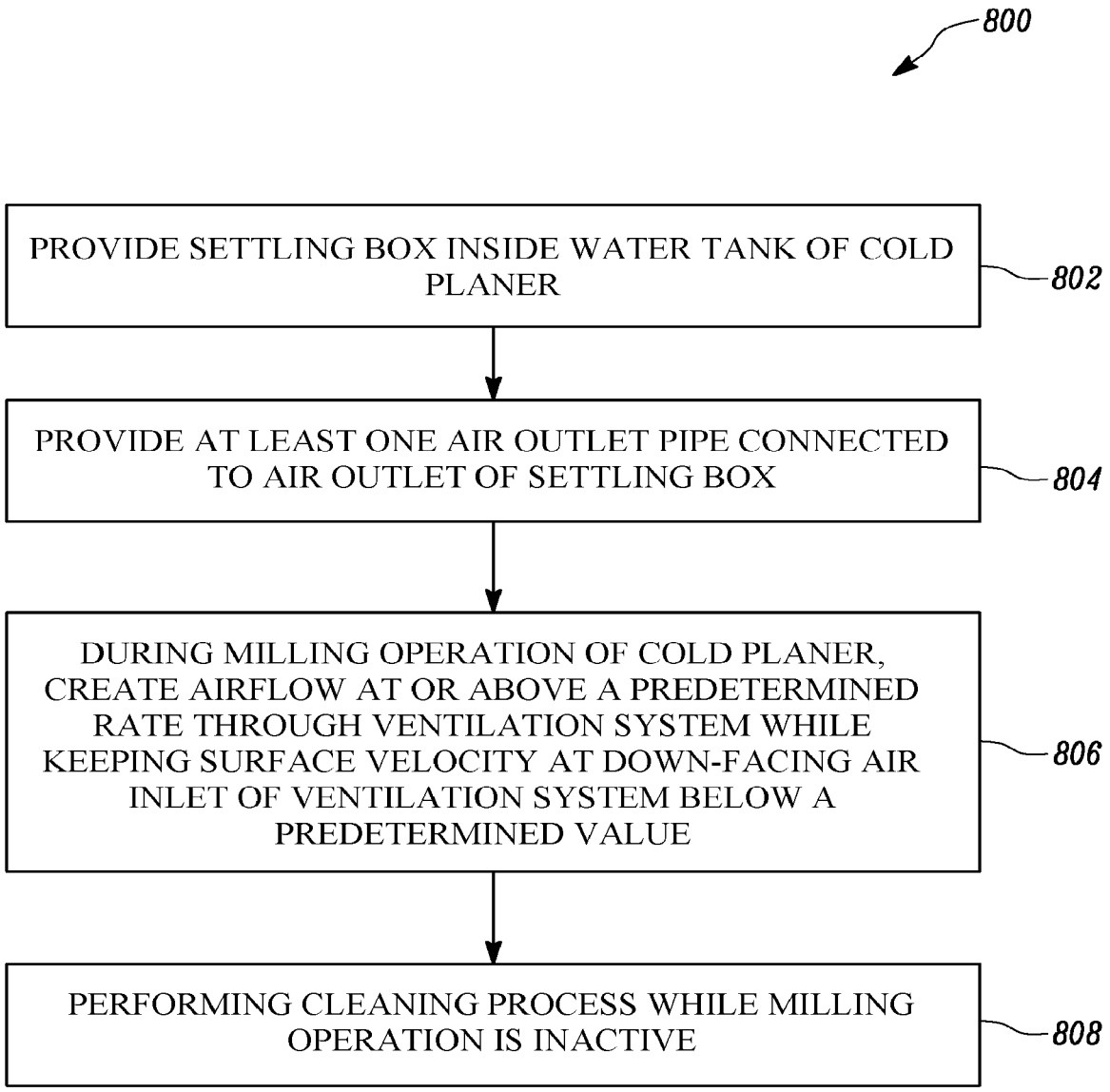
FIG. 8 is a flowchart of a method for providing ventilation for a cold planer, according to one or more embodiments of the present disclosure.

FIG. 8 illustrates a flowchart of a method 800 of providing ventilation for a machine, such as a cold planer machine or the machine 100, according to one or more embodiments of the present disclosure.

At step 802, the method 800 can include providing one or more settling boxes inside a water tank, such as a water tank 134 of the machine 100. The settling box(es), also referred to as pickup box(es), such as the settling box 202, the settling box 204 or the settling box 206 (collectively referred to as "the settling box 202"). As explained earlier, the settling box 202 includes a body, such as the body 208, the body 210 or the body 212 (collectively referred to as "the body 208"), and an air outlet, such as the air outlet 250, the second air outlet 252, the air outlet 254, or the air outlet 256 (collectively referred to as the "air outlet 250"). The body 208 can separate the inner volume of the settling box 202 from the water tank 134. Further, the body has at least one vertically extending sidewall, such as the vertically extending sidewall 226, defining a down-facing air inlet, such as the down-facing air inlet 400 and or the down-facing air inlet 402. Further, as explained earlier, the air outlet 250 is provided on the vertically extending sidewall 226 at a predetermined height above the down-facing air inlet 400. Further, the air outlet 250 has a second cross-section less than the first cross-section of the down-facing air inlet, and can face away from the operator area 110 of the machine 100.

The method 800, at step 804, can include providing at least one air outlet pipe, such as air outlet pipe 258, connected to an air outlet of the settling box, such as the air outlet 250 of the settling box 202. As noted above, the air outlet pipe may pass through the water tank 134, away from the operator area 110 of the machine 100, for instance.

The method 800 can include, at step 806, causing or creating, during the milling operation of the cold planer, airflow at or above a predetermined rate to flow through the ventilation system, while controlling surface velocity at the down-facing air inlets, such as down-facing air inlets 400, 402, to below a predetermined value. As noted above, such combined control of airflow through the ventilation system and the surface velocity at the down-facing air inlets can allow fumes or particles below a predetermined size to pass through the ventilation system and prevent or discourage particles at or above the predetermined size from entering the ventilation system or reaching a predetermined distance inside the ventilation system.

The method 800, at step 806, can include perform a cleaning process while the milling process is inactive. Optionally, step 806 can include stopping the milling process before performing the cleaning process. The cleaning process can include spraying a cleaning fluid into at least one air outlet pipe such as the outlet pipe 258, and allowing the cleaning fluid to gravitationally flow to the settling box, such as settling box 202. After the cleaning process, the ventilation system 134 may be operated for a predetermined duration of time, such as ten minutes, to dry the outlet pipe 258 and the settling box 202.

During operation of the machine 100, i.e., when the milling system 118 breaks up the layer of material of the road surface 104, dust, fumes, small and larger particles of material can be formed. Rotating movement of the milling drum 120 and the resultant centrifugal force causes the small and large particles of the material to move toward the conveyor system 124. Simultaneously, the ventilation system 136 can pull dust that is less than a predetermined size and fumes at the down-facing air inlet 400 into the settling box 202. Specifically, the orientation of the settling box 202, the height of the body 208 of the settling box 202, the inner volume of the settling box 202, and the first cross-section of the down-facing air inlet 400 are configured to allow passage into the ventilation system 136 of fumes and particles no larger than the first size and restrict passage of particles larger than the first size from reaching a predetermined point of the air ventilation system 136, for instance, past the down-facing air inlet 400 (i.e., prevent such particles from entering the ventilation system) or downstream of the down-facing air inlet 400.

Further, operation of the fan 286 of the ventilation system 136 causes air adjacent the down-facing air inlet 400 to be pulled into the inner volume of the settling box 202 by creating airflow through the inner volume of a predetermined rate. The relatively large size of the cross-sectional area of the down-facing air inlet 400 can mandate a surface velocity at the down-facing air inlet 400 that remains below a predetermined value. Accordingly, passage of particles larger than the predetermined size, i.e., the first size, can be restricted. Such configuration of the down-facing air inlet 400 and surface velocity of air created thereby may preclude the need of having any screens, filters, vanes, or grates at the settling box 202, the outlet pipe 278, and the down-facing air inlet 400.

While aspects of the present disclosure have been particularly shown and described with reference to the embodiments above, it will be understood by those skilled in the art that various additional embodiments may be contemplated by the modification of the disclosed machines, systems and methods without departing from the scope of what is disclosed. Such embodiments should be understood to fall within the scope of the present disclosure as determined based upon the claims and any equivalents thereof.

What is claimed is:

1. A ventilation system for a cold planer comprising:

a vertically oriented settling box inside a water tank of the cold planer, the settling box being at a position entirely downstream of a milling drum of the cold planer and above a conveyor belt of the cold planer and having:

a body with a height greater than a width separating an inner volume of the settling box from the water tank, the body having at least one vertically extending sidewall defining a down-facing air inlet having a first cross-section sized to accept fumes and particles with a diameter less than a predetermined diameter generated by operation of the milling drum of the cold planer but to reject particles with a diameter at or greater than the predetermined diameter generated by the operation of the milling drum, and an air outlet provided on the at least one vertically extending sidewall at a height above the down-facing air inlet, the air outlet having a second cross-section less than the first cross-section of the down-facing air inlet and facing away from an operator area of the cold planer;

an outlet pipe connected to the air outlet of the settling box and extending from the air outlet of the settling box such that at least a first portion of the outlet pipe is inclined upward and at least a second portion of the outlet pipe is inside the water tank;

a fan to pull air from below the down-facing air inlet into the settling box, through the air outlet and to the outlet pipe; and a cleaning system configured to clean the vertically oriented settling box and the outlet pipe, the cleaning system including one or more spray nozzles to spray cleaning fluid into the outlet pipe, wherein the outlet pipe is configured to allow the cleaning fluid to gravitationally flow to the air outlet and inner volume of the settling box, and wherein the position and orientation of the settling box in the cold planer, the height of the body of the settling box, the inner volume of the settling box, and the first cross-section of the down-facing air inlet are to configured to cause primarily vertical airflow which, in combination with air pulled from below the down-facing air inlet and through the settling box and the outlet pipe at or above a predetermined flow rate by the fan, is such that a surface velocity of airflow at the down-facing air inlet remains below a predetermined velocity so as to accept the fumes and the particles with the diameter less than the predetermined diameter to pass through the ventilation system but to reject the particles with the diameter at or greater than the predetermined diameter generated from the operation of the milling drum.

2. The ventilation system of claim 1, wherein the at least one vertically extending sidewall of the body of the vertically oriented settling box includes at least three vertically extending sidewalls.

3. The ventilation system of claim 1, further comprising:

another air outlet provided on the at least one vertically extending sidewall at the height above the down-facing air inlet, said another air outlet having a second cross-section less than the first cross-section of the down-facing air inlet and facing away from the operator area of the cold planer; and another outlet pipe connected to said another air outlet of the settling box and extending from said another air outlet of the settling box such that at least a portion of said another outlet pipe is inclined upward.

4. The ventilation system of claim 1, wherein the height of the body of the settling box extends to a top cover of the water tank.

5. The ventilation system of claim 4, wherein the top cover of the water tank defines a top cover of an up-facing opening defined by the least one vertically extending sidewall of the body of the settling box.

6. The ventilation system of claim 4, wherein access to the inner volume of the settling box is provided by removing the top cover of the water tank.

7. The ventilation system of claim 1, wherein the height of the body of the settling box does not extend to a top cover of the water tank.

8. The ventilation system of claim 1, wherein the height of the body of the settling box is half or less than half a height of the water tank.

9. The ventilation system of claim 1, wherein the inner volume of the settling box has a rectangular shape.

10. The ventilation system of claim 1, wherein the inner volume of the settling box has a cylindrical shape.

11. A method of providing for ventilation of a cold planer, the method comprising:

providing a settling box inside a water tank of a cold planer, the settling box being at a position entirely downstream of a milling drum of the cold planer and above a conveyor belt of the cold planer and having:

a body with a height greater than a width separating an inner volume of the settling box from the water tank, the body having at least one vertically extending sidewall defining a down-facing air inlet having a first cross-section sized to accept fumes and particles with a size less than a predetermined size generated by operation of the milling drum of the cold planer but to limit passage of particles with a size at or greater than the predetermined size generated from the operation of the milling drum, and an air outlet provided on the at least one vertically extending sidewall at a height above the down-facing air inlet, the air outlet having a second cross-section less than the first cross-section of the down-facing air inlet and facing away from an operator area of the cold planer;

providing at least one air outlet pipe connected to the air outlet of the settling box and extending from the air outlet of the settling box such that at least a first portion of the outlet pipe runs through the water tank, away from the operator area of the cold planer;

providing a fan to pull air from below the down-facing air inlet into the settling box, through the air outlet and to the at least one air outlet pipe; and providing a cleaning system configured to clean the settling box and the at least one air outlet pipe, the cleaning system including one or more spray nozzles to spray cleaning fluid into the at least one air outlet pipe, wherein the position and orientation of the settling box, the height of the body of the settling box, the inner volume of the settling box, and the first cross-section of the down-facing air inlet are to configured to cause primarily vertical airflow which, in combination with air pulled from below the down-facing air inlet and through the settling box at or above a predetermined flow rate by the fan, is such that a surface velocity of airflow at the down-facing air inlet remains below a predetermined rate so as to accept the fumes and the particles with the size less than the predetermined size to pass through the settling box but to prevent the particles with the size at or greater than the predetermined size generated from the operation of the milling drum from reaching a predetermined point downstream of the down-facing air inlet.

12. The method of claim 11, further comprising during a milling operation of the cold planer, using the fan, pulling air adjacent the down-facing air inlet into the inner volume of the settling box by creating airflow through the inner volume at the predetermined flow rate, while simultaneously keeping the surface velocity of the airflow at the down-facing air inlet to below the predetermined rate.

13. The method of claim 11, further comprising: stopping the milling operation of the cold planer; and performing a cleaning process using the cleaning system, said performing the cleaning process including spraying the cleaning fluid into the at least one air outlet pipe using the one or more spray nozzles and allowing the cleaning fluid to gravitationally flow to the settling box.

14. The method of claim 11, wherein one or more of the settling box and the at least one outlet pipe are free of any screens, filters, vanes, and grates.

* * * * *